US006853121B2

(12) United States Patent
Kim et al.

(10) Patent No.: US 6,853,121 B2
(45) Date of Patent: Feb. 8, 2005

(54) MASK FRAME ASSEMBLY FOR APPLYING OPTIMAL TENSION IN A CRT

(75) Inventors: Sung Hun Kim, Busan-si (KR); Yong Kun Kim, Gumi-si (KR)

(73) Assignee: LG.Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/160,120

(22) Filed: Jun. 4, 2002

(65) Prior Publication Data

US 2003/0030360 A1 Feb. 13, 2003

(30) Foreign Application Priority Data

Aug. 8, 2001 (KR) ..... 2001/47746
Aug. 10, 2001 (KR) ..... 2001/48233

(51) Int. Cl.[7] ..... H01J 29/07
(52) U.S. Cl. ..... 313/407; 313/402
(58) Field of Search ..... 313/402, 403, 313/407; 445/30, 36, 37, 47

(56) References Cited

U.S. PATENT DOCUMENTS 5,801,479 A 9/1998 Shinoda
6,084,342 A * 7/2000 Ragland, Jr. ..... 313/407
6,106,353 A * 8/2000 Kimura et al. ..... 445/30
6,280,276 B1 * 8/2001 Bucher et al. ..... 445/30

* cited by examiner

*Primary Examiner*—Nimeshkumar D. Patel
*Assistant Examiner*—Sharlene Leurig
(74) *Attorney, Agent, or Firm*—Birch, Stewart, Kolasch & Birch, LLP

(57) ABSTRACT

A mask frame assembly in a cathode ray tube is capable of minimizing a howling phenomenon and preventing local wrinkles of a shadow mask by optimizing positioning of compression of the mask frame assembly. A mask frame assembly for applying optimal tension in a cathode ray tube includes a shadow mask for selecting color and a frame assembly having a main frame for applying tension to the shadow mask and a sub-frame for supporting the main frame, wherein each of compression points of the main frame is set to satisfy the following expressions, $(L/2)\times 0.38 \leqq X1 \leqq (L/2)\times 0.52$, and $(L/2)\times 0.80 \leqq X2 \times (L/2)\times 0.98$, where L is a length of a long side of the main frame, X1 and X2 are distances from the center of the main frame to each of compression points P1 and P2 in both sides.

8 Claims, 17 Drawing Sheets

(a)

(b)

(a)

(b)

(c)

(a)

(b)

(c)

MASK FRAME ASSEMBLY FOR APPLYING OPTIMAL TENSION IN A CRT

BACKGROUND OF THE INVENTION

This non-provisional application claims priority under 35 U.S.C. § 119(a) on Patent Application Nos. 47746/2001 and 48233/2001 filed in Korea on Aug. 8, 2001 and Aug. 10, 2001, respectively, which are herein incorporated by reference.

FIELD OF THE INVENTION

The present invention relates to a mask frame assembly, and more particularly to a mask frame assembly for a cathode ray tube which is capable of minimizing a howling phenomenon and preventing local wrinkles of a shadow mask by optimizing positioning of compression of a shadow mask frame assembly.

DESCRIPTION OF THE RELATED ART

FIG. 1 shows a partial sectional view for illustrating a structure of a general flat cathode ray tube. Referring to FIG. 1, the flat cathode ray tube, which is a primary element for displaying pictures in picture display devices such as television receivers and computer monitors, is generally comprised of a panel 1 provided at the front and a funnel 2 provided at the rear.

In addition, the inside of the flat cathode ray tube, which is housed by the panel 1 and the funnel 2, includes a fluorescent screen 3 of R, G, and B for light emission, an electron gun 8 provided inside a neck of the funnel 2 for projecting electron beams 11 for light-emitting the fluorescent screen 3, a shadow mask 4 for selecting color of electron beams 11 from the electron gun 8, a frame assembly 5 provided at a circumference of the shadow mask 4 for applying tension to the shadow mask 4 and supporting it, an inner shield 7 provided at a circumference of the frame assembly 5 for shielding an external earth magnetic field, and a reinforcement band 10 provided around a side of the panel 1 for preventing an external impact.

Further, the outside of the neck of the funnel 2 has a deflection yoke 8 for deflecting up-and-down and left-and-right the electron beams 11 projected from the electron gun (not shown) and two, four and six pole magnets 9 for correcting traveling tracks of the electron so that the projected electron beams 11 hit correctly on a fluorescent substance, so that degradation of color purity is prevented.

FIG. 2 shows a partial sectional view for illustrating a structure of the mask frame assembly of the general flat cathode ray tube, FIG. 3*a* shows a perspective view for illustrating a structure of a tension type mask frame assembly, and FIG. 3*b* shows a perspective view for illustrating a structure of a frame assembly. Here, D portion in FIG. 3*a* is a welding portion.

Referring to FIGS. 2, 3*a* and 3*b*, the frame assembly comprises a main frame 5*a* for applying tension to the shadow mask and a sub-frame 5*b* for supporting the main frame 5*a*. In addition, the mask frame assembly has a structure such that the shadow mask is welded to the frame assembly. The mask frame assembly is fixed to an inner surface of the panel 1 through a spring 6 and a stud pin 1*a* jointed to sides of the main frame 5*a* and the sub-frame 5*b*.

Typically, the shadow mask can be classified into a forming type mask formed by use of a mold, and a tension type mask formed by the application of tension to the mask and the welding.

Since a conventional Braun tube is configured to have a curved surface with a predetermined curvature, there is a drawback in that a distortion of picture and a dazzle by exterior light reflection occurs on a screen, thereby making a viewer's eyes to be fatigued. For overcoming such a problem, there is a need for a cathode ray tube with both inner and outer flat surfaces.

For implementing the flat cathode ray tube with flat surfaces, it is required to make the panel flat and the curvature of the mask more flat. However, it is impossible in the existing forming type mask to make the curvature of a mask more flat. In addition, as the curvature of a mask gets more flat, drop characteristic, i.e., structural strength characteristic of the mask, which is one of the core qualities in the Braun tube, is deteriorated.

As a new concept of a shadow mask for overcoming such a technical difficulty, a tension type mask has been suggested which can implement a flat curvature of a mask by applying tension to the mask and which can secure a structural strength of a mask impossible in the existing forming type mask.

In a CRT with the tension type mask, in order to form a tension type mask frame assembly, the main frame 5*a* is compressed, and then the shadow mask 4 is welded to the main frame 5*a* under the compression state. Next, the compression of the main frame 5*a* is released to apply tension to the shadow mask 4. At that time, distribution of tension applied to the main frame 5*a* is dependent on a position of compression applied to the main frame. As the tension distribution has a smooth U-shaped curve (see FIG. 10), the howling phenomenon, which makes the shadow mask shaking, can be well coped with.

However, as the length of the mask is increasing along with a trend of large sizing of the cathode ray tube, a natural frequency of the mask is decreasing, and accordingly, the shadow mask 4 largely vibrates in a low frequency band of a speaker located at a television sash. Therefore, it is important to set proper positions of compression of the main frame in order to have tension distribution corresponding to various frequency bands against external noise. However, when the compression is performed at conventional compression positions, i.e., $X1=0$ (center portion of the main frame), $(L/2)\times 0.99 \leqq X2 \leqq (L/2)\times 1.00$, and $(L/2)\times 0.55 \leqq X3 \leqq (L/2)\times 0.60$ as shown in FIG. 4, the tension distribution results in a rough U-shaped tension distribution having points of inflection at intermediate portions between the center and the corners of the main frame as shown in FIG. 5. With such a tension distribution, there is a problem in that a range of vibration of the mask is increased such that the mask vibrates largely due to an external noise of the same frequency band in a region near the points of inflection.

In addition, in the case of the forming type mask, wrinkles do not occur in the mask even when a local deformation takes place in the course of welding to the frame. However, in a case of the tension type mask, when the compression of the main frame is released after the main frame is compressed, and then the mask is welded to the main frame, a discontinuous tension distribution is produced by a restoration force of the main frame, starting from a portion at which the sub-frame is located. Due to this, there is a problem in that local wrinkles can occur in the mask as shown in FIG. 6. In addition, wrinkles can occur in the mask due to thermal deformation of the mask by heat generated at the time of mask welding.

As a method for minimizing an unbalance of tension applied to the mask by the restoration force of the frame, there is a method for reducing tension applied to the mask by reducing a compression load of the frame. However, although this method has an effect of preventing the wrinkles of the mask, a resonance frequency, which is a vibration characteristic of the mask, is decreased according to the following expression when tension decreases in the tension type mask.

$$f = \frac{1}{2(L)}\sqrt{\frac{P}{\rho}}$$

Where, f is a natural frequency of the mask, L is a length of a minor axis of a mask effective area, P is tension applied to both ends of the mask, and ρ is mass per unit length.

When the resonance (or natural) frequency decreases, the mask is more sensitive to an external vibration so that a howling characteristic is deteriorated, resulting in degradation of picture quality.

In addition, as a method for preventing wrinkles of the mask due to the thermal deformation of the mask by the welding heat, there is a method for reducing a size of a welding nugget by decreasing an electric current applied at the time of mask welding or by reducing welding time. However, this method also could not overcome the problems caused by the frame, and has an additional problem in that a welding portion easily comes off due to a weak strength of welding.

As described above, the problems of the conventional techniques cannot be solved with the structure of positioning of compression of the existing mask frame assembly.

SUMMARY OF THE INVENTION

Accordingly, the present invention has been made keeping in mind the above problems occurring in the prior art, and an object of the present invention is to provide a mask frame assembly for a cathode ray tube which is capable of minimizing a howling phenomenon and preventing local wrinkles of a shadow mask by optimizing positioning of compression of a shadow mask frame assembly.

In order to accomplish the above object, according to a preferred embodiment of the present invention, a mask frame assembly for applying optimal tension in a cathode ray tube including a shadow mask for selecting color and a frame assembly having a main frame for applying tension to the shadow mask and a sub-frame for supporting the main frame, wherein each of compression positions of the main frame is set to satisfy the following expressions, $(L/2)\times 0.38 \leqq X1 \leqq (L/2)\times 0.52$ and $(L/2)\times 0.80 \leqq X2 \leqq (L/2)\times 0.98$, where L is a length of long side of the main frame, X1 and X2 are distances from the center of the main frame to each of compression positions P1 and P2 in both sides.

According to another preferred embodiment of the present invention, a mask frame assembly for applying optimal tension in a cathode ray tube including a shadow mask for selecting color and a frame assembly having a main frame for applying tension to the shadow mask and a sub-frame for supporting the main frame, wherein both ends of the main frame are compressed for welding the shadow mask, and a compression position of both ends of the main frame is set between an extension line of inner side ends of welding portions of the main frame and the sub-frame and a line perpendicular to an extension line of non-effective area ends of the sub-frame of the shadow mask.

Also, position of compression load is set at the lower portion of the main frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
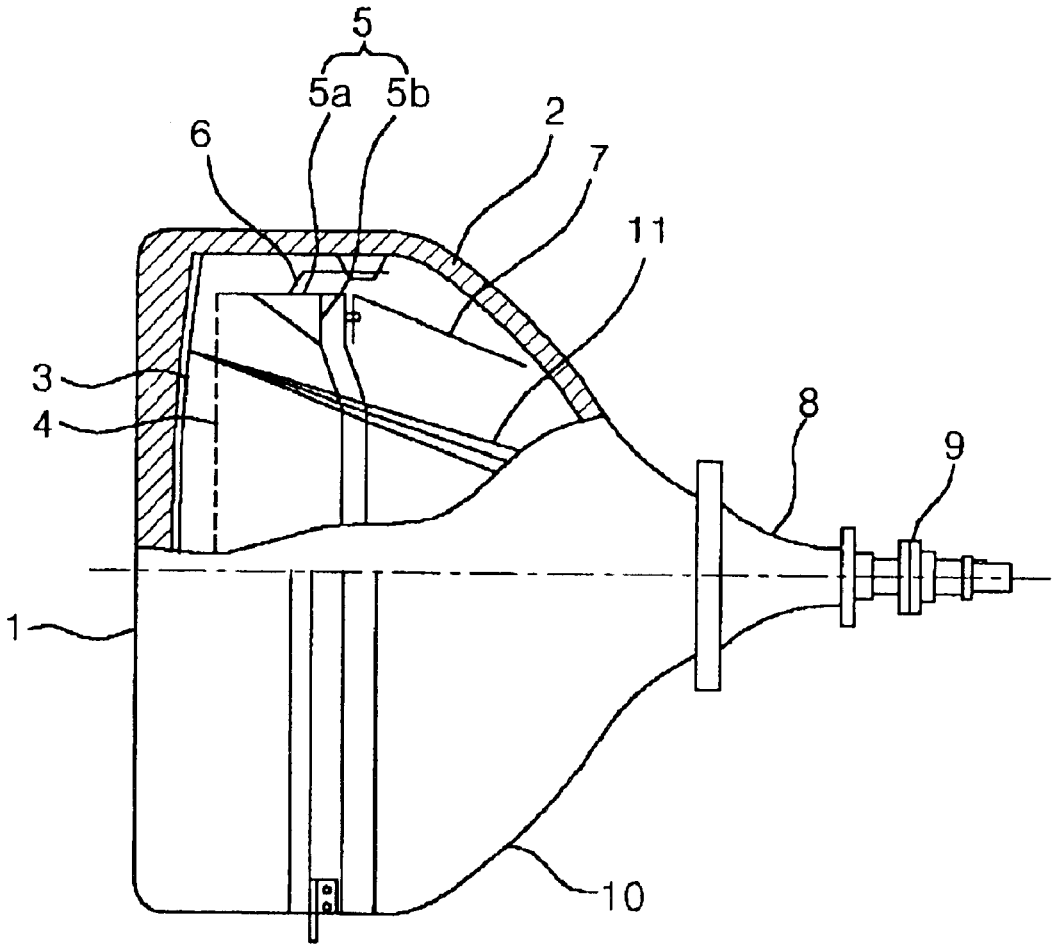
FIG. 1 is a partial sectional view for illustrating a structure of a general flat cathode ray tube.
Figure 2:
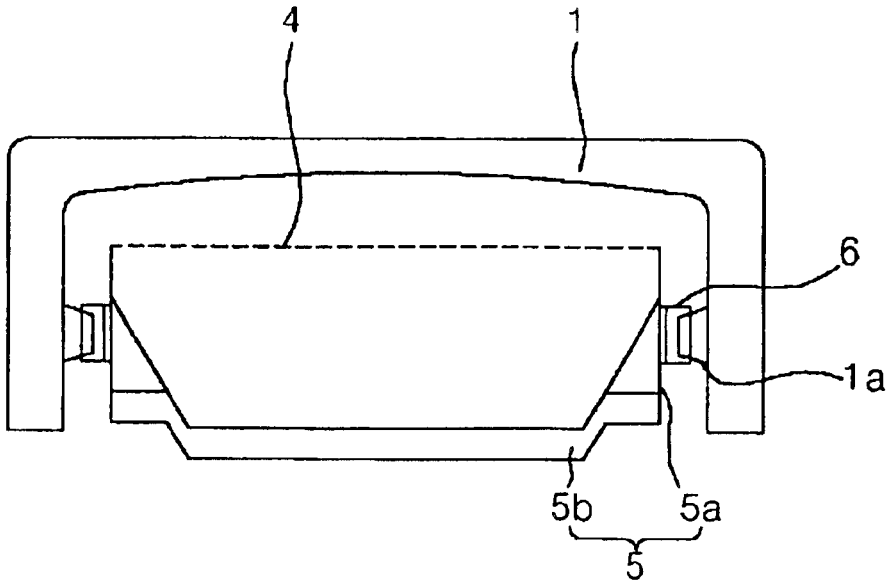
FIG. 2 is a partial sectional view for illustrating a structure of the mask frame assembly of the general flat cathode ray tube.
Figure 3:
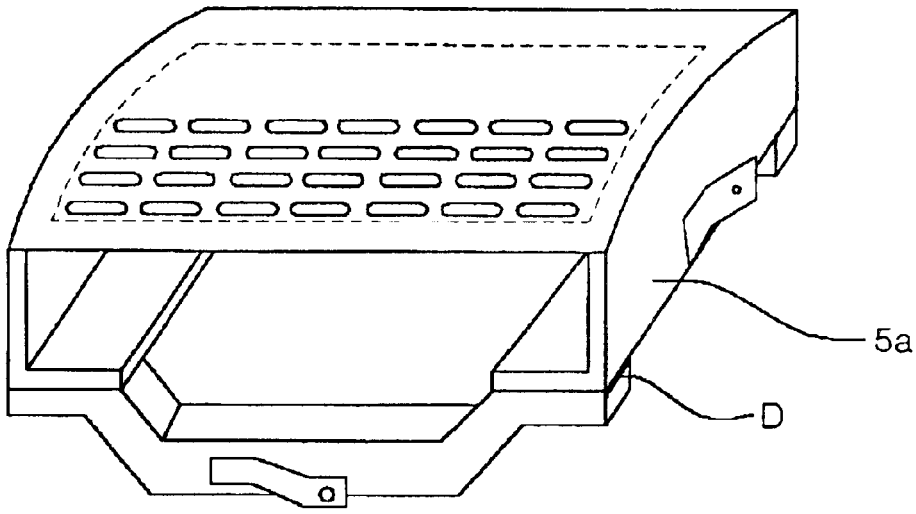
FIG. 3 is a perspective view for illustrating a structure of a tension type mask frame assembly.
Figure 3:
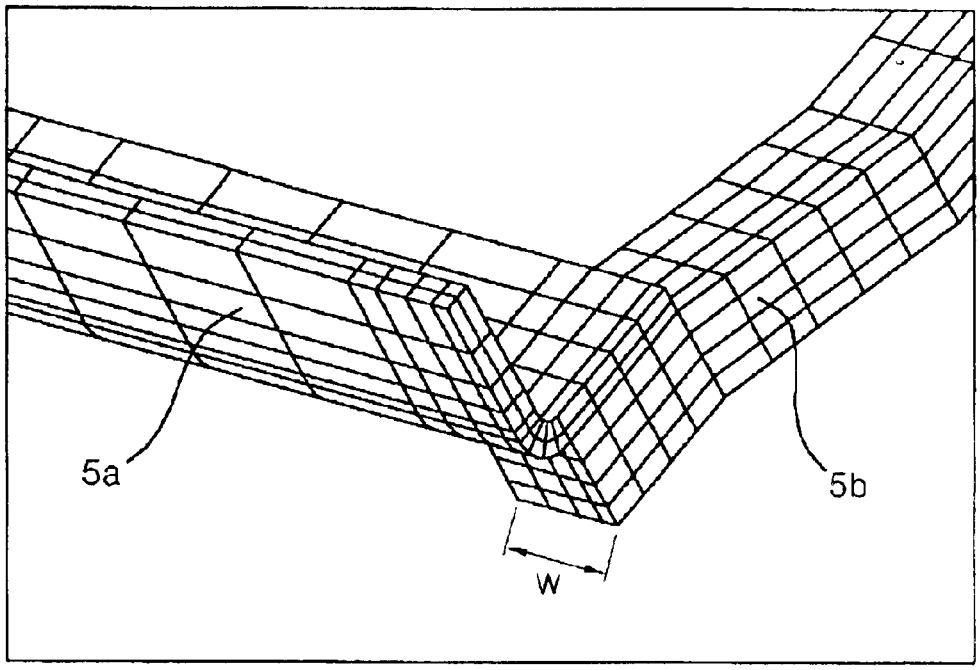
Figure 4:
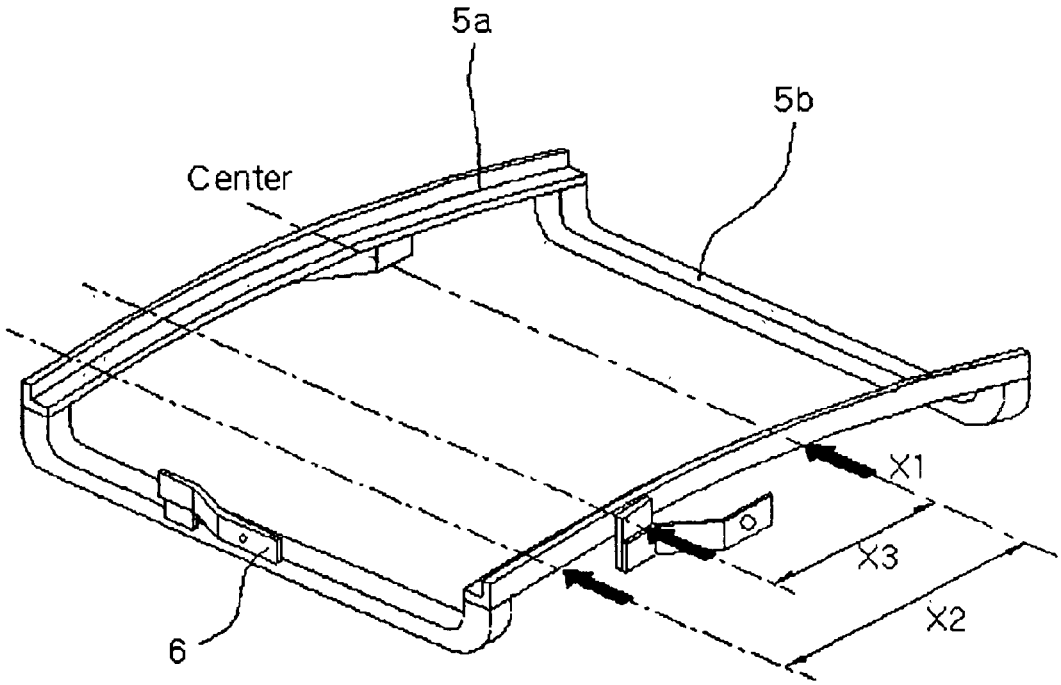
FIG 4 (Related Art)
FIG. 4 is a perspective view of the frame assembly showing a structure of positioning of compression of the main frame according to the prior art.
Figure 5:
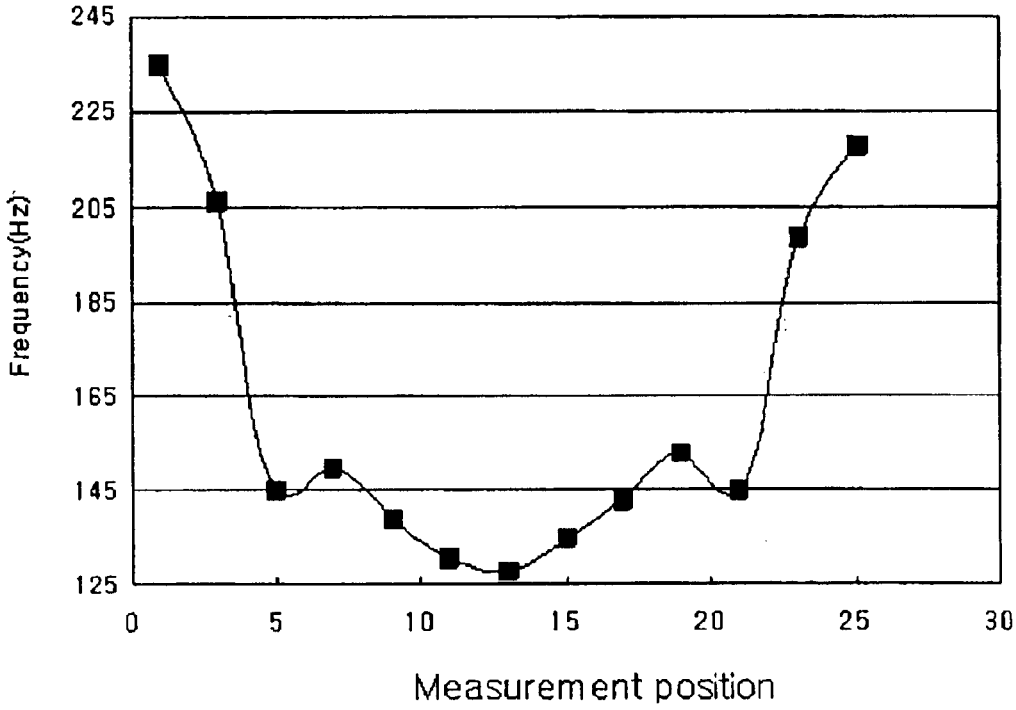
FIG 5 (Related Art)
FIG. 5 is a graph showing tension distribution present in the main frame when a compression force is applied to the frame assembly by the structure of positioning of compression of the main frame according to the prior art.
Figure 6:
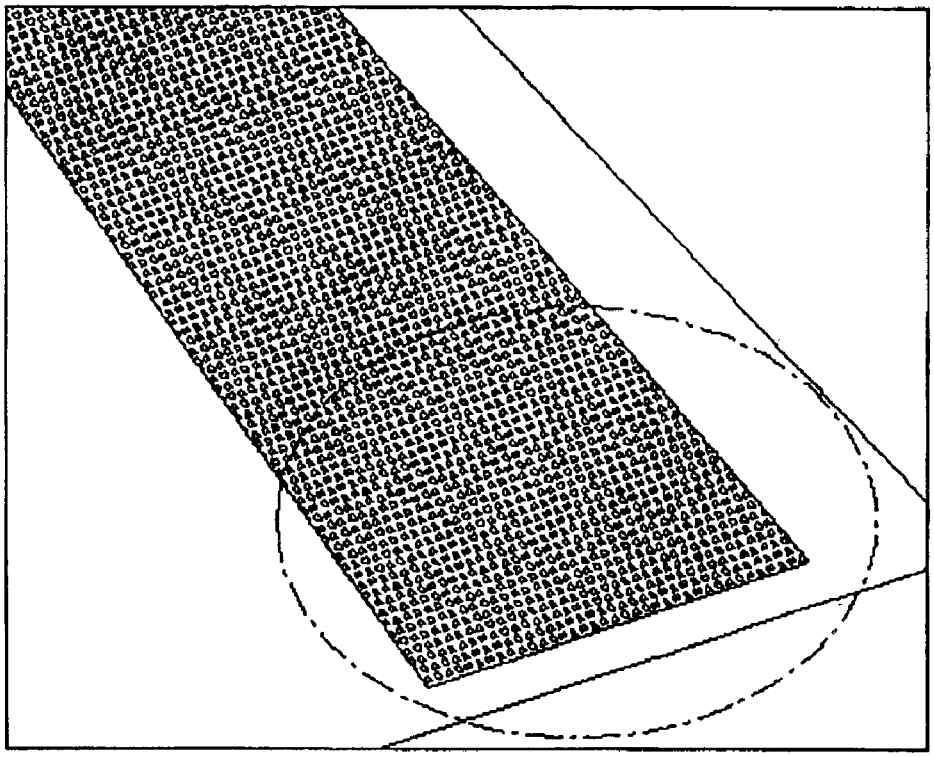
FIG 6 (Related Art)
FIG. 6 is a view showing a local wrinkle shape generated in the conventional shadow mask.

Hereinafter, preferred embodiments of a structure of positioning of compression of the main frame according to the present invention will be described in detail with respect to the accompanying drawings, in which the same reference numerals are used throughout to designate the same or similar components.

Figure 7:
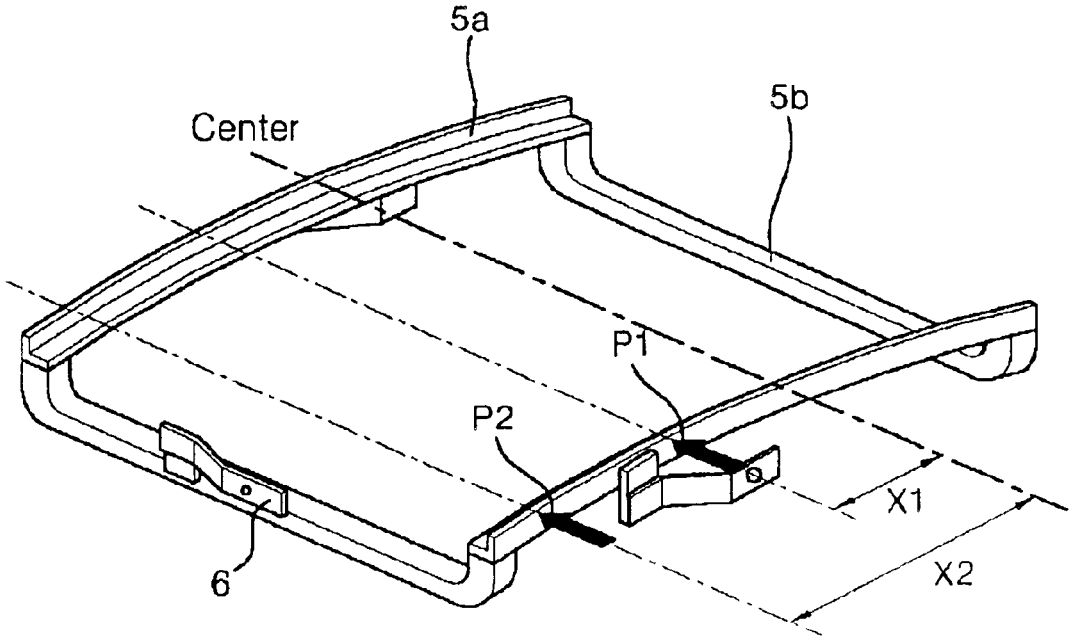
FIG. 7 is a perspective view of the frame assembly for illustrating a first embodiment of a structure of positioning of compression of the main frame according to the present invention.

FIG. 7 is a perspective view for illustrating a structure of positioning of compression of the mask frame assembly according to a first embodiment of the present invention.

Typically, a compression is performed at three compression points in the main frame in order to obtain a U-shaped tension distribution curve for the shadow mask. However, in this case, since tension distribution of an intermediate portion (except for a center and a corner of the main frame) cannot be controlled, it is preferable to set more than four compression points and compress the main frame.

Therefore, in the first embodiment of the present invention, the distribution of tension applied to the shadow mask 4 is optimized by compressing the main frame 5*a* of the frame assembly with a constant load while applying compression load to the four set compression points of the main frame 5*a*.

Here, the compression points of the main frame 5*a* are set as follows:

First, a position range of compression points of the main frame is set to satisfy the following expressions, $(L/2)\times 0.38 \leqq X1 \leqq (L/2)\times 0.52$ and $(L/2)\times 0.80 \leqq X2 \leqq (L/2)\times 0.98$, where L is a length of the main frame 5*a*, X1 and X2 are distances from the center C of the main frame 5*a* to a first compression point P1 and a second compression point P2, respectively, in both sides.

It is preferable to set the compression points P1 and P2 at a symmetrical position around the center C of the main frame. These compression points are a result obtained through an experiment.

The second compression point P2 of the compression points is near a welding portion between the main frame 5*a* and the sub-frame 5*b*. Compressing a portion near the welding portion is for obtaining a desired U-shaped tension distribution curve at a corner portion, which is the largest point of stiffness of the frame assembly. Preferably, when a portion distanced by 98% from the center of the main frame is compressed, largest corner portion tension distribution is obtained.

If the compression points of the main frame are set at points deviated from the position range mentioned above, the tension distribution has points of inflection at which frequency in a portion near the corner is equal to or less than a frequency in a portion near the center at the time of compressing the main frame. As a result, there a problem can occur in that a range of vibration of the mask is increased such that the mask vibrates due to an external noise with same frequency band.

Figure 8:
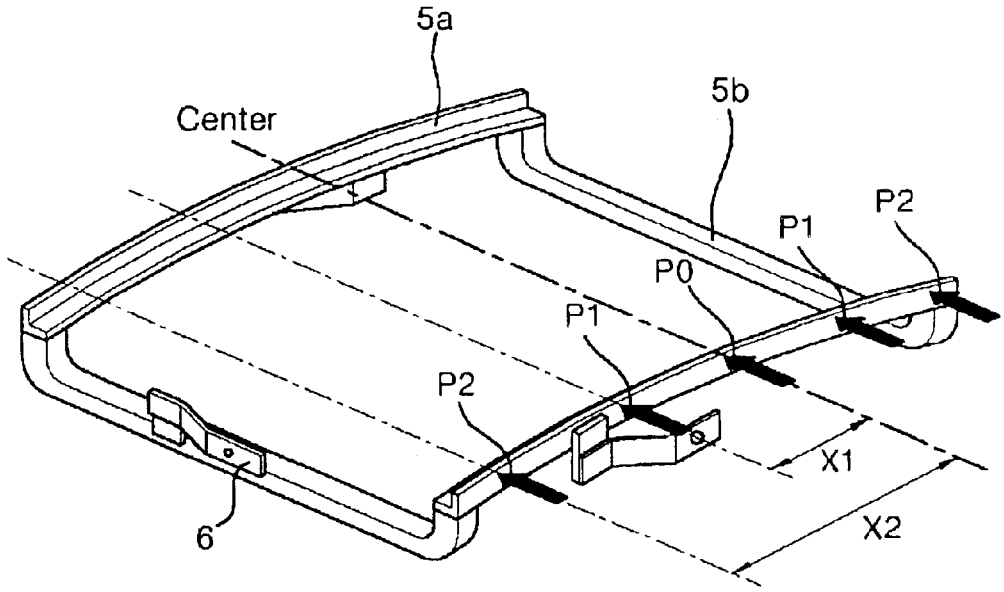
FIG. 8 is a perspective view of the frame assembly for illustrating a second embodiment of a structure of positioning of compression of the main frame according to the present invention.

FIG. 8 is a perspective view for illustrating a structure of positioning of compression of the mask frame assembly according to the second embodiment of the present invention.

The second embodiment of the present invention is for optimizing the tension distribution of the shadow mask 4 by compressing the main frame 5*a* at five compression points. In the second embodiment, a compression point P0 is set at the center C of the main frame in addition to the four compression points P1 and P2 set in the first embodiment.

The mask frame assembly according to the second embodiment has an advantage in that tension at the center can be directly controlled, unlike the case in which the tension distribution is designed with the four compression points. This allows the tension distribution to be applied to the shadow mask 4 as designed, and more easily.

Figure 9:
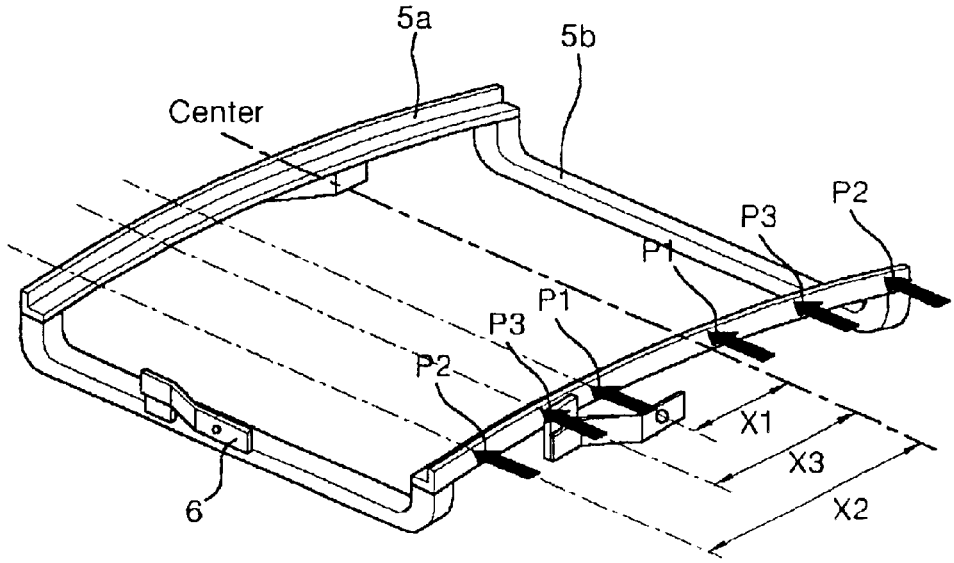
FIG. 9 is a perspective view of the frame assembly for illustrating a third embodiment of a structure of positioning of compression of the main frame according to the present invention.

FIG. 9 shows a third embodiment in which the compression load is applied to six compression points set at the main frame 5*a*.

In the third embodiment, four compression points (P1 and P2) are set at the same points as in FIG. 8 and two additional compression points (P3) are set at points distanced by X3 from the center of the main frame C. Here, the additional compression points (P3) are set in a range satisfying $(L/2)\times 0.66 \leqq X3 \leqq X3 \leqq (L/2)\times 0.80$.

Also, in this case, it is preferable to set to make the compression points of both sides symmetrical around the center C of the main frame.

According to the third embodiment, since two third compression points (P3) are present between two first compression points (P1) and two second compression points (P2), the number of variables which can control the tension distribution are increased. This is in comparison to four or five compression points. This allows the tension distribution between the center and the corner to be applied to the shadow mask as designed (and more easily).

Figure 10:
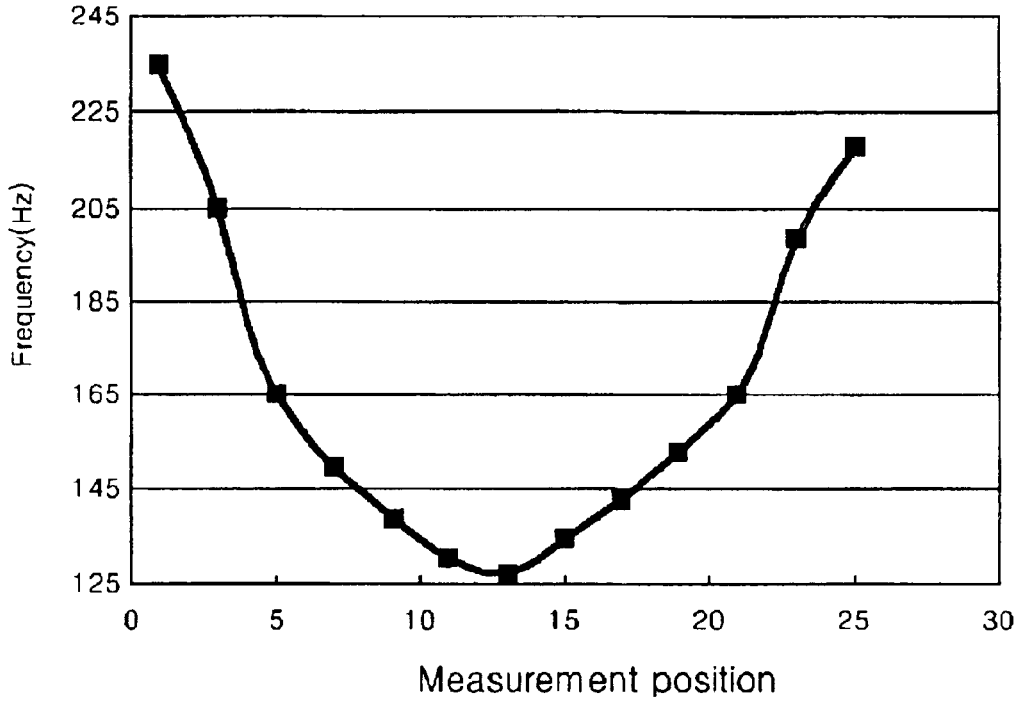
FIG. 10 is a graph showing tension distribution dependent on measurement position of the main frame when a compression force is applied to the frame assembly according to the first embodiment of the present invention.

FIG. 10 is a graph showing a tension distribution of the shadow mask 4 when the compression load is applied to the compression points (P1 and P2) set according to the first embodiment of the present invention.

Referring to FIG. 10, it can be seen that the tension distribution curve is a smooth U-shaped curve without any point of inflection.

Figure 11:
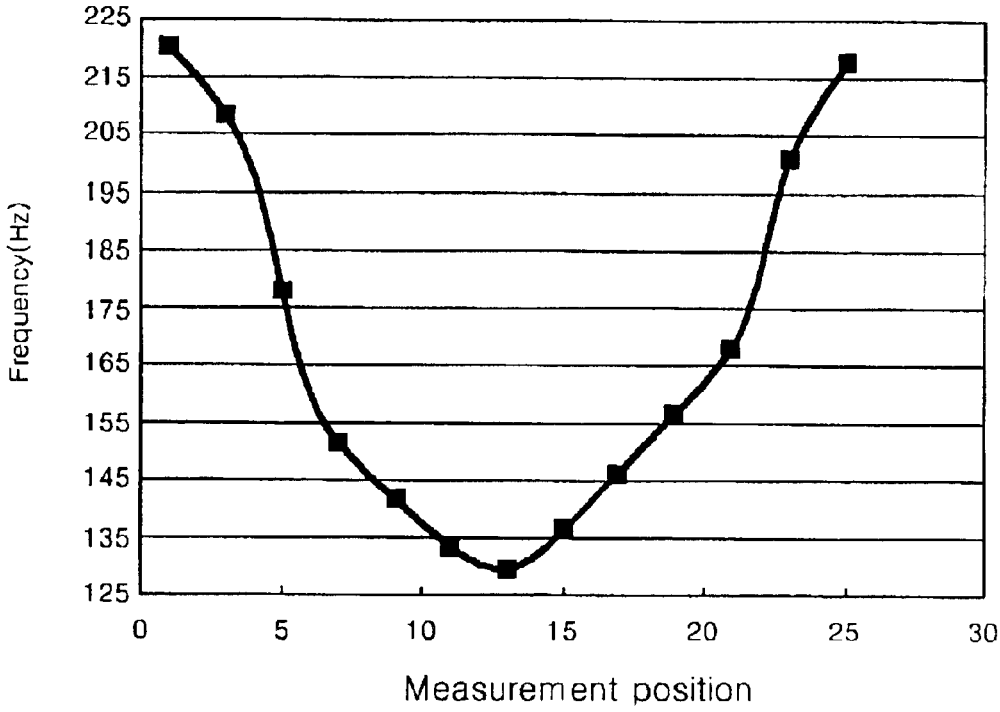
FIG. 11 is a graph showing tension distribution dependent on a measurement position of the main frame when a compression force is applied to the frame assembly according to the second embodiment of the present invention.

FIG. 11 is a graph showing tension distribution of the shadow mask 4 when the compression load is applied to the compression points (P0, P1 and P2) set according to the second embodiment of the present invention.

Referring to FIG. 11, it can be seen that the tension distribution curve is a smooth U-shaped curve without any point of inflection.

Figure 12:
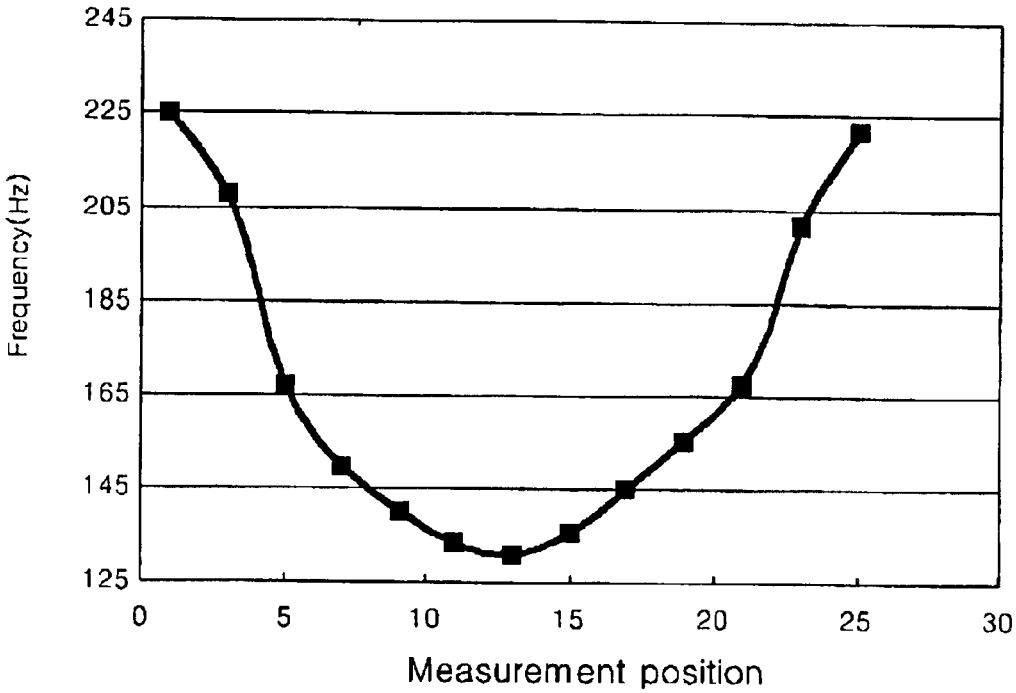
FIG. 12 is a graph showing tension distribution dependent on a measurement position of the main frame when a compression force is applied to the frame assembly according to the third embodiment of the present invention.

FIG. 12 is a graph showing tension distribution of the shadow mask 4 when the compression load is applied to the compression points (P1, P2 and P3) set according to the third embodiment of the present invention;

Referring to FIG. 12, it can be seen that the tension distribution curve is a smooth U-shaped curve without any point of inflection.

Thirteen plotted points of measurement (points 1 to 25) in FIGS. 10 to 12 are points at which frequency is measured from a left end to a right end of the main frame. Namely, it represents that frequency is measured at 13 points of a long side of the main frame.

The center portion of the main frame has a value measured at the 13th point (the point at which the frequency is lowest) and the corner portion has values measured at the first and 25th points.

Figure 13:
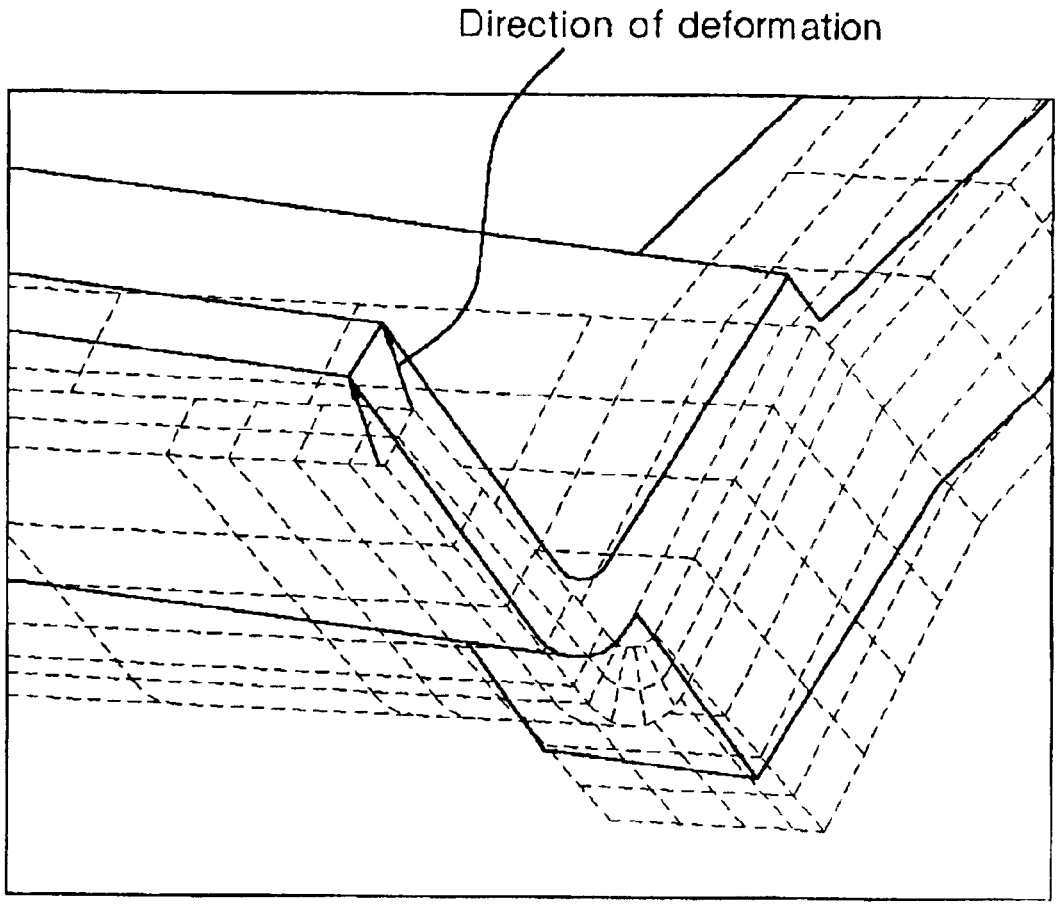
FIG. 13 is a view showing a deformation of the main frame when it is compressed.

FIG. 13 is a view showing a direction in which deformation of the main frame is generated when it is compressed.

As shown in FIG. 13, when the mask is welded to the main frame in which the deformation is generated due to the compression load, and then the compression load applied to the main frame is released, a restoration force is applied in a direction opposite to the direction in which the deformation is generated by the compression load. At that time, an angle made by the direction of the restoration force and a vertical axis is referred to as "working angle" of the restoration force and a degree of deformation in a direction of the vertical axis which is generated at the time of compression is referred to as "Y deformation".

The working angle of the restoration force is the cause of occurrence of mask wrinkles, dependent on its magnitude and discontinuity. At the time the mask is welded, it is advantageous that the working angle is changed as little as possible in the vertical direction of the main frame, and the working angle of the restoration force applied to the main frame should be continuous. If discontinuous points occur, mask wrinkles also occur since a tension direction is twisted when the mask is tensed at the discontinuous points along the direction of the restoration force of the main frame. Even when the mask wrinkles do not occur immediately after welding, the mask wrinkles occur through a heat process since the mask has stress.

In the present invention, an effective position of compression load of the main frame for reduction of mask wrinkles was confirmed through a simulation.

Figure 14:
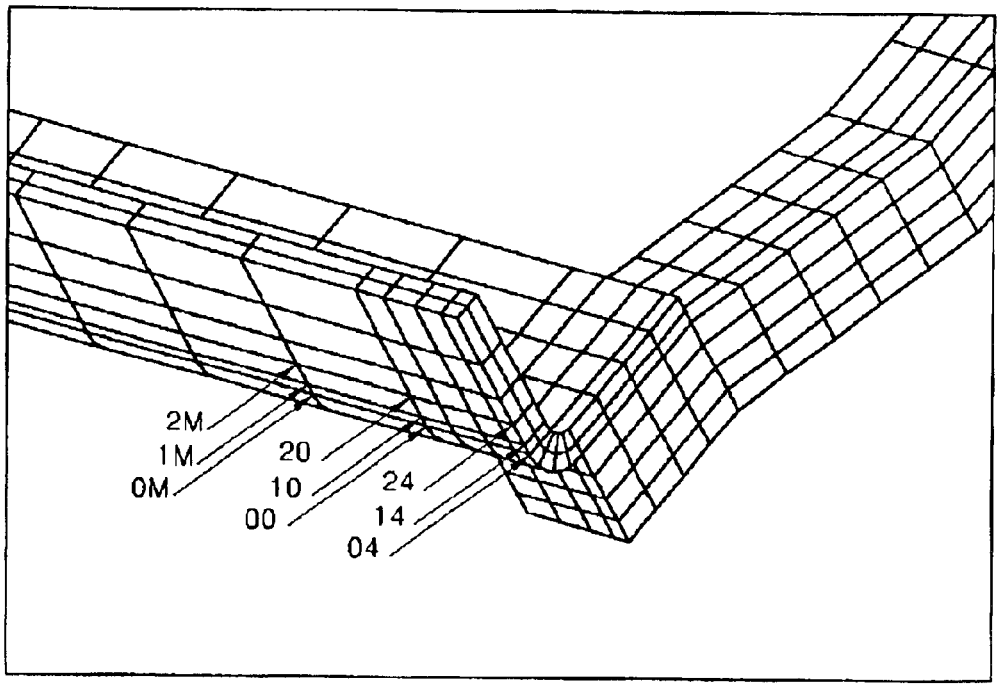
FIG. 14 is a view showing a compression simulation position of the main frame for experiments of other preferred embodiments of the present invention.
Figure 15:
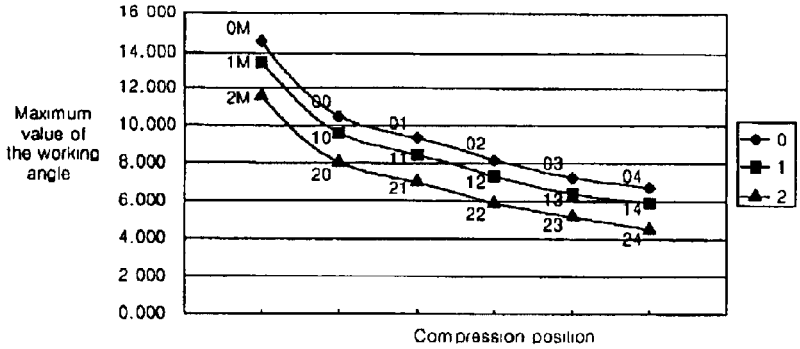
FIGS. 15*a* to 15*c* are views showing working angles of a restoration force of the main frame dependent on the compression position.
Figure 15:
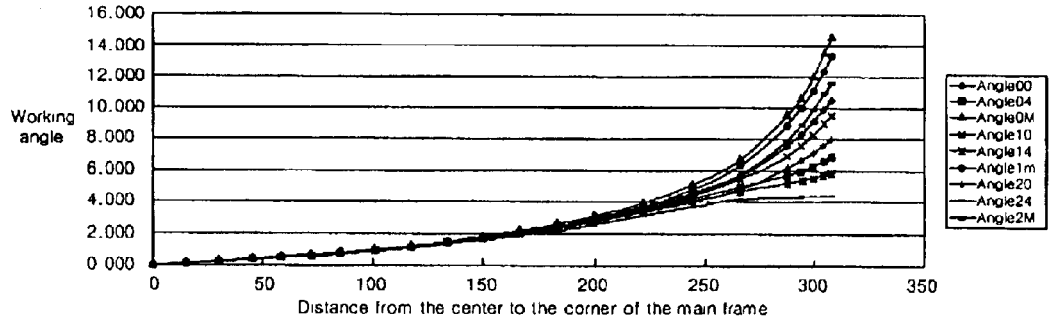
Figure 15:
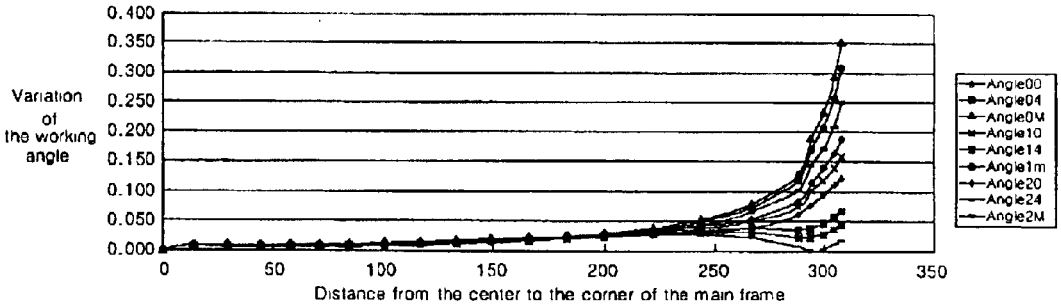
Figure 16:
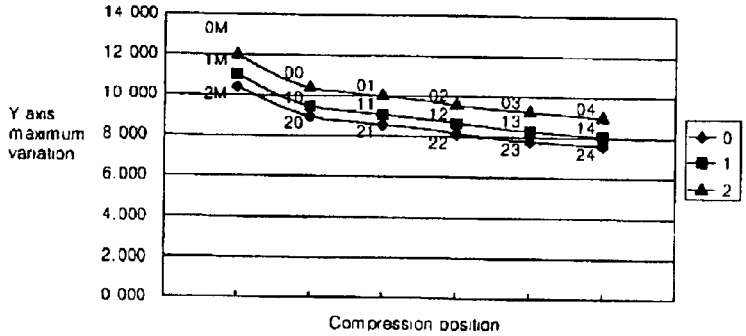
FIGS. 16*a* to 16*c* are views showing Y deformation dependent on the compression position.
Figure 16:
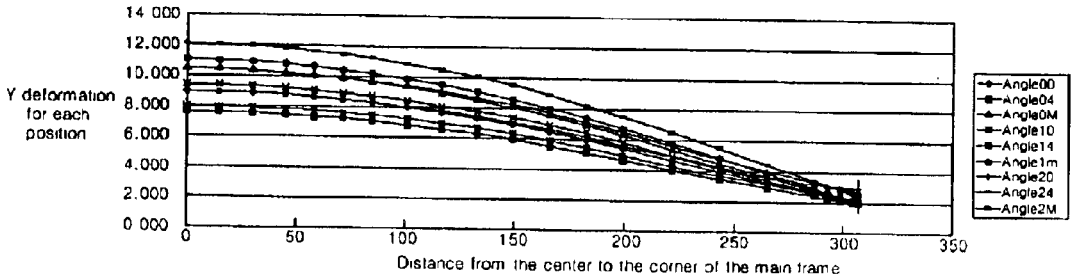
Figure 16:
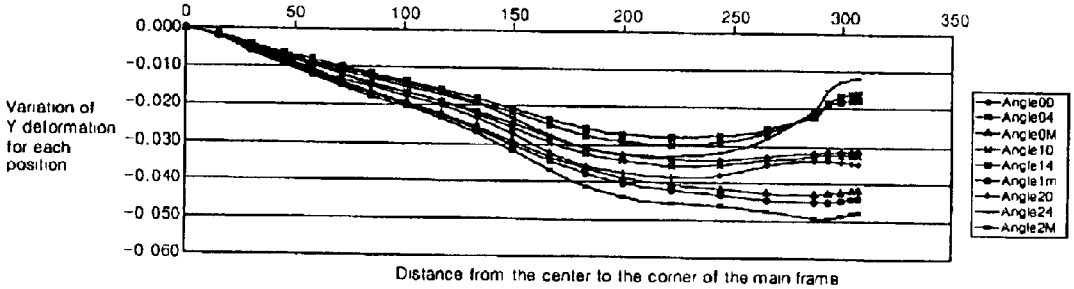

FIG. 14 is a view showing a compression simulation position, and FIGS. 15 and 16 show results of the simulation. FIG. 15*a* is a graph showing a maximum value of the working angle of the restoration force at the time of compressing the main frame, dependent on the compression position. In addition, FIGS. 15*b* and 15*c* are graphs showing the working angle and a variation of the working angle of the restoration force, respectively, at the time of compression, dependent on a distance from the center to the corner of the main frame before compression. Here, 2M, 1M, 0M, 20, 10, 00, etc., (marked on the graphs) are numbers for distinguishing the compression points, all of the numbers being the denotation for the compression points of the simulation shown in FIG. 14. In addition, in 2M, 1M, 0M, 20, 10, 00, etc., first numbers, i.e., 2, 1, and 0, designate a compression height of the simulation shown in FIG. 14. Also, a horizontal axis denotes a distance from the center to the corner of the main frame, a reference point 0 is the center of the main frame, a portion above 300 is an end of the main frame, and vertical axes are the working angle and a variation of the working angle, respectively.

In addition, referring to FIG. 14, 0 denotes compression of a lowest portion of the main frame, and an increase in the number from 1 to 2 denotes compression of an upper portion of the main frame. Second character M denotes compression of the main frame with a constant interval from a point inside an extension line (A portion in FIG. 17) of an inner side end of the welding portion of the sub-frame to the outside of the main frame, and the farther toward the outside the main frame is, the number increases from 0 to 4.

First, consider a result of the simulation in case that the compression load is applied to 2M, 1M, and 0M points inside an extension line (A portion in FIG. 17) of an inner side end of the welding portion of the sub-frame as shown in FIG. 14. At that time, as shown in FIGS. 15*a* and 15*b*, the working angle of the restoration force is largest at 2M, 1M, and 0M points, and the farther toward the outside the main frame is, the more the working angle of the restoration force decreases.

From the above result, it can be seen that mask wrinkles are more effectively prevented as the compression point goes from 2M, 1M, and 0M points inside an extension line (A portion in FIG. 17) of an inner side end of the welding portion of the sub-frame toward the outer side end of the welding portion of the sub-frame.

However, referring to FIG. 15*c*, it can be seen that the variation of the working angle of the restoration force dependent on the compression point is gradually increasing, and after that, is decreasing when 24, 14, and 04 points at the outer side end of the main frame are compressed.

Therefore, when 24, 14, and 04 points at the outer side end of the main frame are compressed as described above, a point of inflection at which the working angle of the restoration force is increasing, and after that, is decreasing takes place. Mask wrinkles can occur at the point of inflection.

FIG. 16*a* is a graph showing a maximum value of Y deformation at the time of the compression of the main frame, dependent on the compression position.

In addition, FIGS. 16*b* and 16*c* are graphs showing Y deformation and a variation of Y deformation, respectively, at the time of compression dependent on a distance from the center to the corner of the main frame before compression. Here, 2M, 1M, 0M, 20, 10, 00, etc., (marked on the graphs) are numbers for distinguishing the compression points and have the same meaning as in FIGS. 15*a* to 15*c*. Also., a horizontal axis denotes a distance from the center to the corner of the main frame, a reference point 0 on the horizontal axis is the center of the main frame, and a portion above 300 is an end of the main frame (similar to FIGS. 15*b* and 15*c*). However, vertical axes are Y deformation for each position and a variation of Y deformation for each position, respectively.

In addition, Y deformation is referred to as deformation of the vertical axis which occurs along with the working angle at the time: of compressing. Similar to the working angle, Y deformation also is the cause of the occurrence of mask wrinkles dependent on its magnitude and discontinuity. The less the Y deformation, the less stress is applied to the mask. Also, if there are points at which Y deformation occur discontinuously, mask wrinkles occur.

Y deformation shows the same result as the working angle of the restoration force dependent on the composition point as shown in FIG. 14. In other words, Y deformation is great as the compression point goes toward the center of the main frame and Y deformation is small as the compression point goes toward the corner of the main frame.

From the above result, it can be seen that mask wrinkles are more effectively prevented as the compression point goes from 2M, 1M, and 0M points inside an extension line (A portion in FIG. 17) of an inner side end of the welding portion of the sub-frame to the outer side end of the welding portion of the sub-frame.

However, referring to FIG. 16*c*, a point of inflection at which the variation of Y deformation dependent on the compression point is increasing, and after that, is decreasing takes place when 24, 14, and 04 points at the outer side end of the main frame are compressed. Mask wrinkles can occur at the point of inflection.

Figure 17:
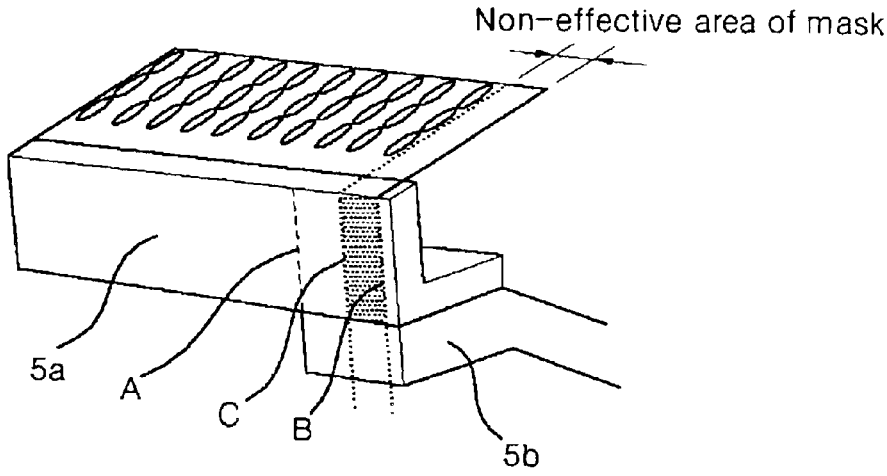
FIG. 17 is a view showing compression positions in other preferred embodiments of the present invention.

Therefore, mask wrinkles can be most effectively prevented when the main frame is compressed between A and B of FIG. 17.

In addition, the higher up the main frame is, the more mask wrinkles easily occur due to local deformation generated in the mask by a high compression load. Therefore, as a position of compression load is moved to a lower portion of the main frame, the mask wrinkles can be reduced.

Here, A is an extension line of the inner side end of the welding portion of the sub-frame and B is a line perpendicular to an extension line of a non-effective area (a portion surrounding an effective area, in which an electron beam passage hole is not formed) of the sub-frame of the shadow mask.

In addition, when tension is applied to the tension type mask, the greatest tension is applied to the non-effective area of the mask, which can rotate the non-effective area of the mask. This can result in deterioration of picture quality by affecting outmost electron beams.

Therefore, in order to prevent this, if a position of compression load of the main frame is set between a line (C portion in FIG. 17) perpendicular to an extension line of a boundary line of the effective area (a portion in which an electron beam passage hole is formed) and the non-effective area and a line (B portion in FIG. 17) perpendicular to an extension of the non-effective area end of the sub-frame of the shadow mask, uniform tension is applied to the non-effective area, thereby preventing the rotation of the non-effective area and the mask wrinkles.

In addition, the farther up the main frame, the mask wrinkles easily occur due to local deformation generated in the mask by a high compression load. Therefore, as position of compression load is moved to a lower portion of the main frame, the mask wrinkles can be reduced.

As described above, according to the present invention, even when a size of the cathode ray tube is varied, compression points at which optimal tension distribution corresponding to the variation can be applied to the shadow mask. In addition, a range of vibration of the shadow mask can be minimized against external noises having various frequency bands, thereby preventing the howling phenomenon.

In addition, according to the present invention, while both ends of the main frame are compressed for shadow mask welding, by setting compression position of both ends of the main frame between an extension line (A portion in FIG. 17) of the inner side end of the welding portion of the main frame and the sub-frame and a line (b portion in FIG. 17) perpendicular to an extension of the non-effective area end of the shadow mask, the wrinkles generated locally in the mask can be prevented.

Particularly, by setting a compression position of both ends of the main frame between a line (c portion in FIG. 17) perpendicular to an extension line of a boundary line of the effective area and the non-effective area and a line (b portion in FIG. 17) perpendicular to an extension of the non-effective area end of the sub-frame of the shadow mask, mislanding of outmost electron beams can be prevented, thereby preventing deterioration of picture quality.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A mask frame assembly for applying optimal tension in a cathode ray tube, comprising:

a shadow mask for selecting color;

a frame assembly including a main frame for optimizing distribution of tension applied to said shadow mask such that a range of vibration of said shadow mask is decreased; and a sub-frame for supporting the main frame, wherein the mainframe has a plurality of compression point portion thereof, the locations of each of said compression points being identified by the following expressions, $$(L/2)\times 0.38 \leqq X1 \leqq (L/2)\times 0.52, \text{ and}$$

$$(L/2)\times 0.80 \leqq X2 \leqq (L/2)\times 0.98,$$

where L is a length of a long side of the main frame, X1 and X2 are distances from the center of the main frame to each of compression points P1 and P2 in both sides.

2. The mask frame assembly according to claim 1, wherein an additional compression point is located at said center of the main frame.

3. The mask frame assembly according to claim 2, wherein a distance X3 from the center of the main frame to the location of an additional compression point satisfies the following expression, $$(L/2)\times 0.66 \leqq X3 \leqq (L/2)\times 0.80.$$

4. The mask frame assembly according to claim 1, wherein the compression points of the main frame are symmetrically located around the center of the main frame.

5. The mask frame assembly according to claim 3, wherein the compression points of the main frame are symmetrically located on each side of said center of the main frame.

6. A mask frame assembly for applying optimal tension in a cathode ray tube, comprising:

a shadow mask for selecting color; and a frame assembly having a main frame for distributing tension to said shadow mask such that a range of vibration of said shadow mask is minimized against external noises having various frequency bands; and a sub-frame for supporting the main frame, wherein compression points are located at a lower portion of the main frame at each end of the main frame between an extension line of inner side ends of welding portions of the main frame and the sub-frame and a line perpendicular to an extension line of non-effective area ends of the sub-frame of said shadow mask, so that local wrinkles of said shadow mask are prevented.

7. The mask frame assembly according to claim 6, wherein compression point locations at each of the ends of the main frame are between a line perpendicular to an extension line of a boundary line of an effective area and the non-effective area and a line perpendicular to an extension of the non-effective area end of the sub-frame of said shadow mask.

8. A mask frame assembly for applying optimal tension in a cathode ray tube, comprising:

a shadow mask for selecting color, said shadow mask having both a plurality of rows and a plurality of columns of electron beam passage holes in an effective area thereof;

a frame assembly including a main frame continuously optimizing distribution of tension applied to said shadow mask; and a sub-frame for supporting the main frame, wherein the mainframe has a plurality of compression points at a lower portion thereof, the location of each of said compression points being identified by the following expressions, $$(L/2)\times 0.38 \leqq X1 \leqq (L/2)\times 0.52, \text{ and}$$

$$(L/2)\times 0.80 \leqq X2 \leqq (L/2)\times 0.98,$$

where L is a length of a long side of the main frame, X1 and X2 are distances from the center of the main frame to each of compression points P1 and P2 in both sides.

* * * * *